United States Patent [19]

Perini

[11] Patent Number: 4,690,088

[45] Date of Patent: Sep. 1, 1987

[54] SAIL RIGGING WITH FAIRING

[76] Inventor: Fabio Perini, Via Fornace, 55100 San Michele di Moriano, Lucca, Italy

[21] Appl. No.: 885,559

[22] Filed: Jul. 14, 1986

[30] Foreign Application Priority Data

Jul. 23, 1985 [IT] Italy ..... 9460 A/85

[51] Int. Cl.[4] ..... B63H 9/06; B63H 9/08

[52] U.S. Cl. ..... 114/102; 114/90; 114/92; 114/94; 114/108; 114/39

[58] Field of Search ..... 114/90, 92, 94, 102, 114/103, 104, 105, 106, 107, 108, 39, 39.1, 39.2

[56] References Cited

U.S. PATENT DOCUMENTS

| | | | |
|---|---|---|---|
| 2,561,253 | 7/1951 | Wells-Coates | 114/102 |
| 2,569,318 | 9/1951 | Kersten | 114/90 |
| 3,132,620 | 5/1964 | Court | 114/102 |
| 3,147,729 | 9/1964 | Barnard | 114/103 |
| 3,580,203 | 5/1971 | Martin | 114/39 |
| 4,064,821 | 12/1977 | Roberts et al. | 114/90 |
| 4,263,861 | 4/1981 | Vicard | 114/90 |
| 4,324,192 | 4/1982 | Ingouf | 114/106 |
| 4,526,122 | 7/1985 | Kluckhuhn | 114/94 |
| 4,593,638 | 6/1986 | Cochran et al. | 114/103 |

FOREIGN PATENT DOCUMENTS

| | | | |
|---|---|---|---|
| 2951209 | 6/1981 | Fed. Rep. of Germany | 114/102 |
| 3211641 | 10/1983 | Fed. Rep. of Germany | 114/103 |
| 2516045 | 5/1983 | France | 114/108 |

*Primary Examiner*—Joseph F. Peters, Jr.
*Assistant Examiner*—Thomas J. Brahan
*Attorney, Agent, or Firm*—Francis J. Bouda

[57] ABSTRACT

The present sailboat sail has extremely high aerodynamic efficiency. The sail has a bifurcated forward edge, the forward ends (17A) of each of which is carried by a footing rope (45) in a track of a vertical stay (22); a fairing (44) is arranged to wrap around the leading edge of a mast (3), and the fairing has a pair of trailing edges (44A), each of which has a footing rope also disposed to be connected to said vertical stays (22); the stays (22) can be separated by a spacer (42) to control the aerodynamic disposition of the trailing edges (44A) of the fairing (44) and the leading edges (17A) of the bifurcated portion of the sail; an enlargement member (46) may be disposed between the inside of the leading edge of the fairing and the outside of the leading edge of the mast further to improve the aerodynamic disposition of the fairing and sail.

8 Claims, 5 Drawing Figures

SAIL RIGGING WITH FAIRING

The present invention relates to the nautical arts and particularly to the construction and fabrication of a sailboat sail having improved aerodynamic characteristcs which improve the efficiency of the airfoil of the sail.

BACKGROUND OF THE INVENTION

The design of sails for sailing craft has occupied the attention and consideration of man ever since boats have been powered by the force of the wind.

However, it has not been until the long-distance commercialization of sailing vessels which required efficient operation of sails for industrial or war-time maneuvering and speed that truly careful attention has been paid to the aerodynamic contours and airfoil design of the sails.

Although the designs have consistently improved over the years with a competitive factor becoming increasingly important in such commercial considerations as the speed of the "Clipper" ships, the highly technical aspects of sail design have occupied more times and attention during the last century with such non-commercial activities as the "America's Cup Race". Millions of dollars have been spent on developing the smallest details of the ships, their sails, and their designs and construction so that the minutest improvement which could give even a small edge in competitive race was important.

Many publications, patents, disclosures, and designs have been directed to the fabrication and construction of the sail and its rigging, and I draw attention and consideration to U.S. Pat. Nos.:

2,561,253
3,132,620
3,260,230
3,487,800
3,598,075
3,802,371
3,935,828
4,211,179
4,283,943
4,388,888
4,437,425
4,463,699

As is evident, it is not new to design, fabricate, and/or construct an improved sailing craft sail. However, in the present invention, the leading edge of a sail is constructed with a unique fairing which envelopes the mast and provides the smoothest continuum of an air foil from the leading edge of the fairing around and behind the mast and into the body of the sail itself, so as to avoid eddy currents and air flow interruption across the total continuum of the sail and the mast.

SUMMARY OF THE INVENTION

The present invention provides a sail and rigging capable of improving the efficiency thereof, and particularly of the spanker sail mounted on the mast, along with its associated boom. All of this is realized through a simple, reliable, durable and easily demountable fairing, which approves the formation of the sail contour and the associated mast, and thus increases aerodynamic efficiency of the sail.

In the present invention, a fairing is provided in such a way that it envelopes the front and sides of the mast with the vertical edges thereof trailing slightly behind the mast. Each of these edges has a footrope fitted thereto.

The leading edge of the sail is bifurcated in a forward-extending direction, so that in cross-section the sail has a configuration of the letter "Y". To each of the forwardly-extending edges of the "Y"-portion, a footrope is also secured.

Interconnecting the trailing edges of the fairing and the forwardly-extending edges of the bifurcated portions of the sail are a pair of stays. Each stay has a plurality of channels formed therein, in which the footropes are free to move and which interconnect the adjacent and opposing edges of the fairing and the sail.

The stays also have appropriate track-means to support a spacer or spreader which operates to hold the stays apart from one another, if desired.

The stays are long, thin, and flexible, and extend vertically, parallel to the mast, generally from the top of the boom to the top of the mast. The fairing of textile material or the like thus circles most of the mast, can slide along and around the mast.

Thus the improved construction of the present invention supplies a relatively simple and uncomplicated means of connecting the sail to the mast while improving the aerodynamic efficiencies of the assembly, and without interfering with the general construction of the ship, the mast, the boom, and any rigging such as the crosstrees or other supporting or navigating devices.

The principal object of the present invention is to provide an improved sailing vessel having unique aerodynamic design.

Another object of the present invention is to provide improved rigging for mounting a sail to the mast of a sailboat under conditions which provide improved aerodynamic performance of the sail.

Another object of the present invention is to provide a fairing for a sailboat sail which envelopes the mast and eliminates the eddy-drag of any air-currents which would destroy the efficiency of the flow of the wind past the mast and across the face of the sail.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
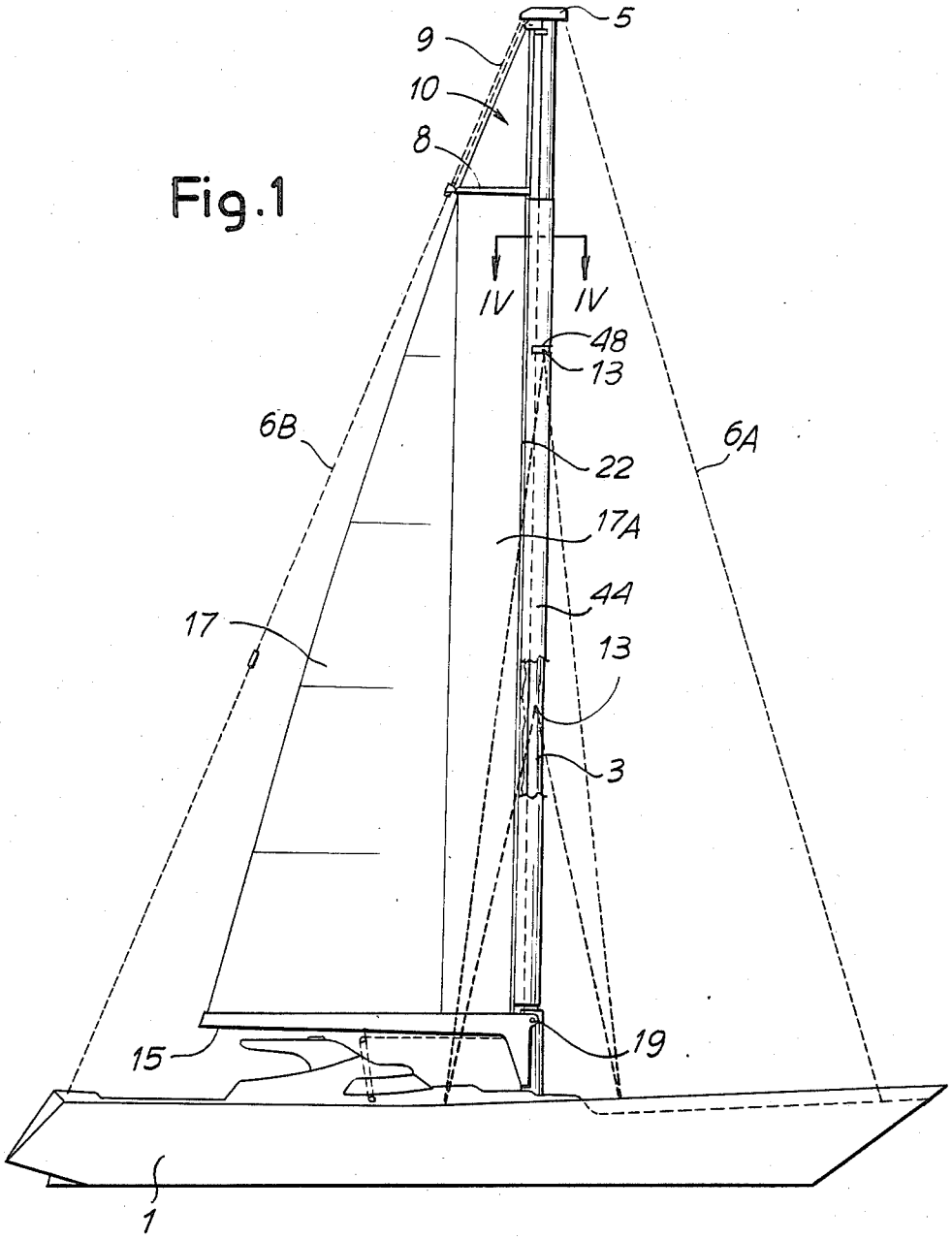
FIG. 1 is a vertical elevational view of the sailboat having the improved sail construction of the present invention.
Figure 2:
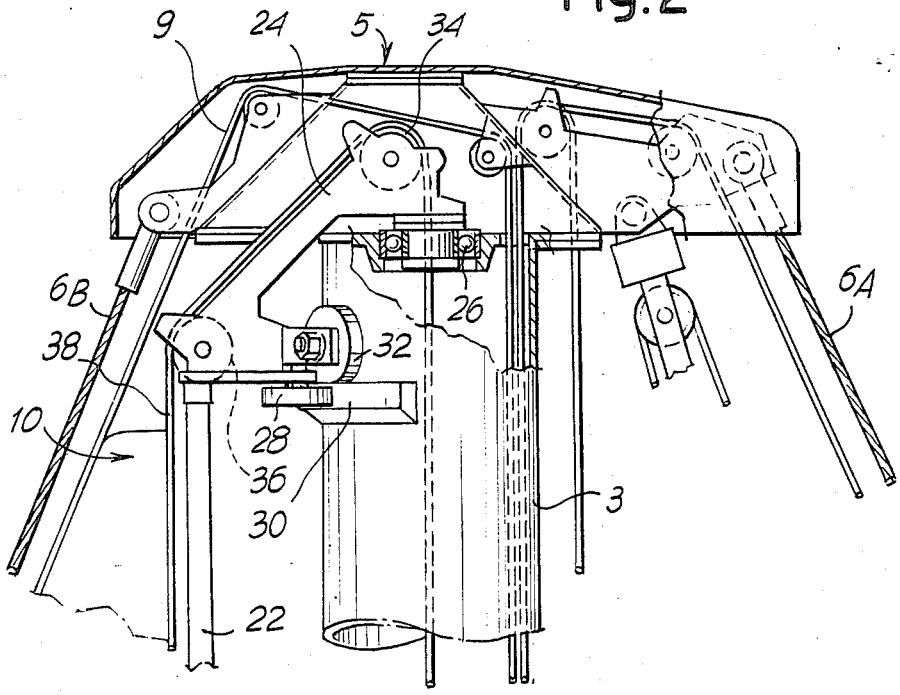
FIG. 2 is a fragmentary vertical elevational view of the mounting bracket at the top portion of the mast of boat of FIG. 1 and the rigging associated therewith.
Figure 3:
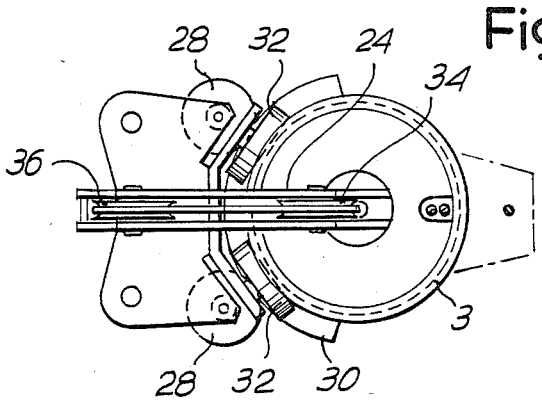
FIG. 3 is a plan view of the mounting bracket at the top of the mast.

Referring now to the drawings and particularly to FIG. 1, numeral 1 indicates a hull, numeral 3 indicates the mast, and numeral 5 indicates a support at the top of the mast for anchoring bow stay 6A and stern stay 6B, respectively. The small boom or peak 8, of well-known construction, can be arranged to be handled by a halyard 9. A top end panel 10, like a board, a swing-beam, or the like, may be associated with the small boom or peak 8.

The mast 3 usually has crosstrees, like those indicated by 13, in combination with shrouds and stays to ensure the mast stability and position. Numeral 15 indicates the boom which engages the spanker sail 17 which may be rolled up inside said boom in a well-known manner. The boom 15 can be supported on the mast 3, as generally indicated at 19, so that it can be pivoted around the axis of the mast 3 and also be pivoted around an axis disposed at a right angle to the mast 3.

In my invention the sail 17, in combination with the mast 3, is faired in order to reach a greater efficiency, through a leading-edge wing-contour of the cross-section of same sail 17.

To this end, according to the invention, I construct the mast 3 with a circular cross-section suitable for any sail altitude. Secondly, I provide a fairing 44, around the mast 3, having two stays 22 which extend vertically parallel along the mast 3, between the boom 15 and a mast-head 24. The mast-head 24 is mounted on the end of the mast 3 so as to be able to rotate about the mast axis with the help of a suitable bearing 26 for the mast-head 24. The mast-head 24 is arranged to rest radially against the mast end on two wheels 28 that can rotate around vertical axes and roll along an arcuate track in a bracket 30 which is also fastened to the mast. Two wheels 32 which are carried on horizontal axes by the mast-head 24 can also rotate on the bracket 30.

The mast-head 24 has two transmission pulley 34 and 36 for a halyard 38 which extends through the inside of the mast 3. Halyard 38 passes through a central opening in the bearing 26, over the transmission pulley 34 and then the pulley 36, for directly or indirectly engaging the top end of the sail. Thus, by pulling on halyard 38 at its bottom end in the lower end of the mast 3, by turning drive means (not shown) inside the boom 15, it is possible to lift the sail 17. The halyard 38 can also be arranged together with the small boom or peak 8 to lift the panel 10.

Each of the stays 22 has three channels for footropes. Between two facing channels 22-A of the two stays 22, a spacer 42 is placed, which is intended, either in tension or compression, to ensure the proper distance between the two stays. The trailing edges 44-A of the fairing 44 are anchored in channels 22-B, facing the mast 3, of each of the stays 22. Said fairing 44 surrounds the mast 3 and thereby forms a portion of wing contour to be completed by the main portion of the spanker sail 17. The spanker sail 17 is fabricated with a double (bifurcated) leading edge close to the mast and the fairing. This bifurcating portion is indicated by 17-A. The two edges 17-A of the leading edge have footropes 45 in the disposed channels 22-C of the stays 22. Channels 22-C are opposite to the channels 22-B engaging the ends 44-A of fairing 44. The upper ends of the footropes 45 can be connected to the halyard 38 in order that the sail 17 may be handled by the halyard 38.

Figure 4:
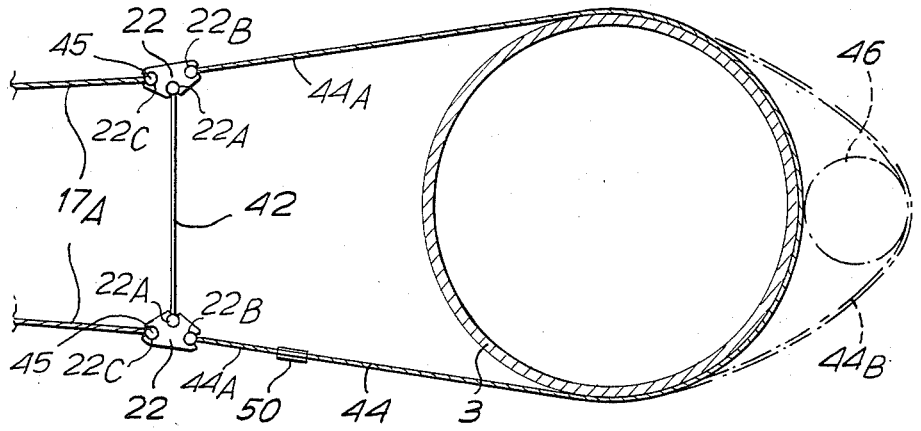
FIG. 4 is a horizontal cross-sectional view taken generally along line 4—4 of FIG. 1.
Figure 5:
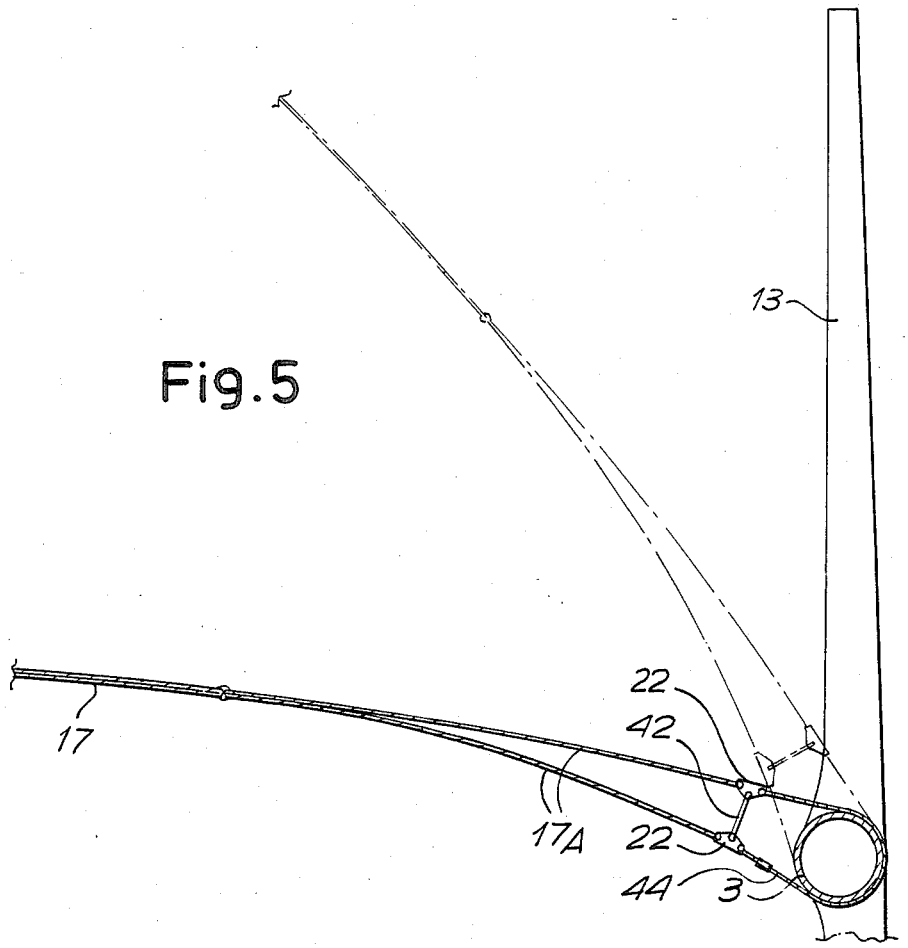
FIG. 5 is an idealized schematic view of the sail of the present invention illustrating several positions or attitudes of the sail and fairing construction of the present invention.

Therefore, a sail is formed which exhibits a wing contour in its horizontal cross-section, with the thicker part of the leading edge being formed by the fairing 44 wrapped around the mast 3. Furthermore, the fairing 44, in symmetrical position in respect to the fairing anchorages in the channels 22-B of the stays 22, can be shaped so that the leading edge 44-B of the fairing can be shaped more efficiently than that obtainable only through the circular cross-section of the mast 3. In FIG. 4, the dotted line indicates a contour 44-B of the fairing 44 created by the presence of an enlargement or swelling 46 which may be a tube-like member capable of rolling along the front part of the outer surface of the mast 3. This enlargement 46 shifts the modified fairing 44-B to a position diametrically across the mast 3 to that taken up by the stays 22, for the necessary orientation of the spanker 17 in relation to the wind to be exploited.

The fairing 44 may be made of flexible material, even of the same fabric of which the sail is made. It may have transverse slots 48 in correspondence with the crosstrees 13 on the mast 3 (or whatever other projections such as lights, indicators, etc., that may be present on the mast). The slots 48 are horizontally placed at any position where necessary, to such an extent that is sufficient to ensure that the fairing can turn to whatever portion or attitude is required for best exploitation of the wind. For assembly or disassembly, a vertical opening 50 is provided in the fairing 44 in proper disposition to the slots 48. The opening 50 must be closed by suitable means, such as "zippers" or the like.

The sail 17 may be controlled in the usual manner for reefing and carrying out any other maneuver that is typical and can be required for this type of sail. In particular, the sail may be rolled within the boom. The small boom or peak 8 can be handled in the usual and traditional manner by the halyard 38 (as well as by the one indicated by 9) since this peak 8 is engaged along its forward edge, with means provided for the sail in the channels 22-C of the stays 22.

It is evident that the sail 17-17-A can be removed and assembled without any particular difficulty. Moreover, this arrangement accommodates the presence of crosstrees and other possible projections associated with the mast 3 without interfering with the operation of the fairing. The sail of this invention is particularly reliable, is not perishable, can be easily disassembled for storage, is reliable owing to its simple construction and the use of structures and components of fully traditional type and, besides, it is long-lasting since it does not include members subjected to particular stress in use.

It is to be understood that the present invention may be embodied in other specific forms without departing from the spirit or special attributes hereof, and it is therefore desired that the present embodiments be considered in all respects as illustrative, and therefore not restrictive reference being made to the appended claims rather than to the foregoing description to indicate the scope of the invention.

What I claim is:

1. A sail of improved aerodynamic efficiency for a sailboat having a mast and a boom, said sail including a spanker portion and a fairing portion interconnected by a stay, said fairing portion having trailing edges, the leading edge of the spanker portion being bifurcated and disposed in said stay so that each portion of said bifurcated edge is in alignment with a trailing edge of said fairing, said stay includes at least two seperate portions, each having channels therein, and wherein the leading edges of the bifurcated portion of the sail and the trailing edges of the fairing all have footropes disposed and arranged to lie within a juxtaposed channel in the adjacent stay portion.

2. The sail of claim 1 wherein an enlargement member is disposed between the inner surface of the leading edge of the fairing member and the outer surface of the leading edge of the sailboat mast whereby to change the contour of the leading edge of said fairing.

3. The sail of claim 1 wherein said stay consists of two separate stay elements, separated by a removable spacer, said spacer having edges disposed to be engaged in juxtaposed channels in said stay elements.

4. The sail of claim 3 wherein said stay elements and spacer are disposed rearwardly behind the leading edge of said fairing and rearwardly of the mast.

5. The sail of claim 1 wherein said fairing has apertures therein capable of permitting projections on the mast to pass therethrough without interfering with the movement of said fairing.

6. The sail of claim 1 having a halyard which can be operated through a hollow central portion of the mast, said halyard being attached to the upper ends of the footropes of the bifurcated leading edges of the sail.

7. The sail of claim 1 which includes a mast-head capable of being mounted at the top of the mast and supported thereon for rotary movement around the axis of the mast.

8. The sail of claim 7, in which said mast-head comprises: a bearing coaxial to the mast and mounted on the top of said mast; wheels on vertical axis for rolling bearing laterally on the mast and wheels on horizontal axis for rolling bearing on a lateral bracket of the mast end.

* * * * *